US006159022A

United States Patent [19]

Tsai

[11] Patent Number: 6,159,022

[45] Date of Patent: Dec. 12, 2000

[54] UNIVERSAL ELECTRICAL CONNECTOR STATION

[75] Inventor: Thomas R. L. Tsai, Tu-Chen, Taiwan

[73] Assignee: Hon Hai Precision Ind. Co., Ltd., Taipei Hsien, Taiwan

[21] Appl. No.: 09/304,319

[22] Filed: May 3, 1999

[30] Foreign Application Priority Data

Dec. 31, 1998 [TW] Taiwan ..... 87222054

[51] Int. Cl.[7] ..... H01R 9/09

[52] U.S. Cl. ..... 439/76.1; 439/391

[58] Field of Search ..... 439/76.1, 731, 439/906, 610; 361/391, 394, 395, 399, 424, 415, 422, 752, 759, 736, 783

[56] References Cited

U.S. PATENT DOCUMENTS 4,399,487 8/1983 Neumann ..... 361/391
5,091,826 2/1992 Arnett et al. ..... 361/408
5,130,893 7/1992 Straate et al. ..... 361/592
5,836,774 11/1998 Tan et al. ..... 439/76.1
5,984,731 11/1999 Laity ..... 439/676

*Primary Examiner*—Khiem Nguyen
*Assistant Examiner*—J. F. Duverne
*Attorney, Agent, or Firm*—Wei Te Chung

[57] ABSTRACT

A universal electrical connector station includes an upper shell (1), a lower shell (3) and a circuit board (2) with several connectors (21) mounted thereon. Each shell (1, 3) has a body (11, 31) and several side walls (12, 13, 32, 33, 34, 35) extending from edges of the body (11,31). A number of openings (36) are defined in predetermined positions of the side walls (32, 34) for receiving connectors (21) therein. The shells (1,3) form several ribs (17, 39) on inner side walls of the shells (1, 3) for supporting the circuit board (2) at a predetermined position after the upper and lower shells (1, 3) are assembled together. A pair of upper and lower locking structures (14, 38) is provided on opposite side walls (13, 14, 33, 35) of the upper and lower shells (1, 3) in a same direction, respectively, for assembling the upper and the lower shells (1, 3) together.

7 Claims, 5 Drawing Sheets

UNIVERSAL ELECTRICAL CONNECTOR STATION

BACKGROUND OF THE INVENTION

The present invention relates to a universal electrical connector station.

Connectors for transferring signals or power between a computer and exterior devices, such as a printer, a keyboard and a monitor, are commonly assembled within an enclosure of the computer. The connectors occupy a significant amount of space within the computer thereby increasing the dimension thereof. To reduce the dimension of the computer, especially a notebook computer, the connectors are commonly disposed outside of the computer and concentrated in a station. The station connects the computer and the exterior devices by a small number of high-density cables and corresponding connectors.

Taiwan Patent Application Nos. 80113315 and 87801097 disclose two kinds of stations. However, such stations do not supply enough ports to connect with the computer and the related exterior devices, thus, applications thereof are limited. Moreover, the stations usually comprise an upper shell and a lower shell, and the ports for receiving connectors having many pins are disposed where the shells are engaged. However, the ports are not durable enough to sustain an insertion/withdrawal force of the connectors and will deform thereby adversely affecting electrical connections between the station and the connectors which may also disrupt signal transmission.

BRIEF SUMMARY OF THE INVENTION

A main object of the present invention is to provide a universal electrical connector station that can be used on all sides thereof wherein proper signal transmission is ensured therethrough.

Another object of the present invention is to provide a universal electrical connector station that can be quickly assembled and easily disassembled.

Accordingly, a universal electrical connector station includes an upper shell, a lower shell, and a circuit board with several connectors mounted thereon. Each shell has a body and several side walls extending from edges of the body. A plurality of openings is defined in predetermined positions of the side walls for receiving connectors therein. The shells form several ribs on inner side walls of the shells for supporting the circuit board at a predetermined position after the upper and lower shells are assembled together. A pair of upper and lower locking structures are respectively provided on opposite side walls of the upper and lower shells in a same direction for assembling the upper and the lower shells together.

Other objects, advantages and novel features of the invention will become more apparent from the following detailed description when taken in conjunction with the accompanying drawings.

DETAILED DESCRIPTION OF THE INVENTION

Figure 1:
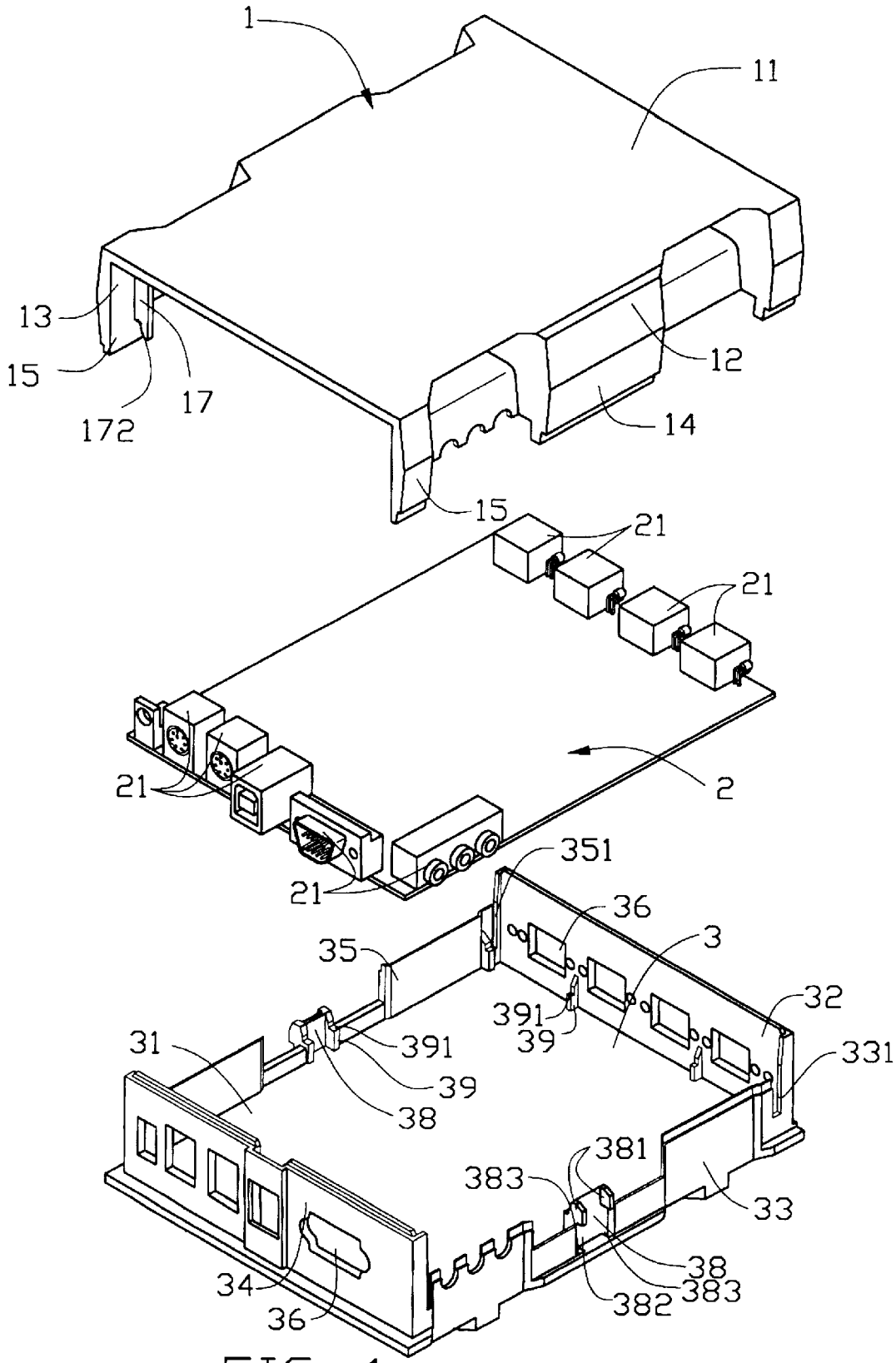
FIG. 1 is an exploded view of the electrical connector station in accordance with a preferred embodiment of the present invention.
Figure 2:
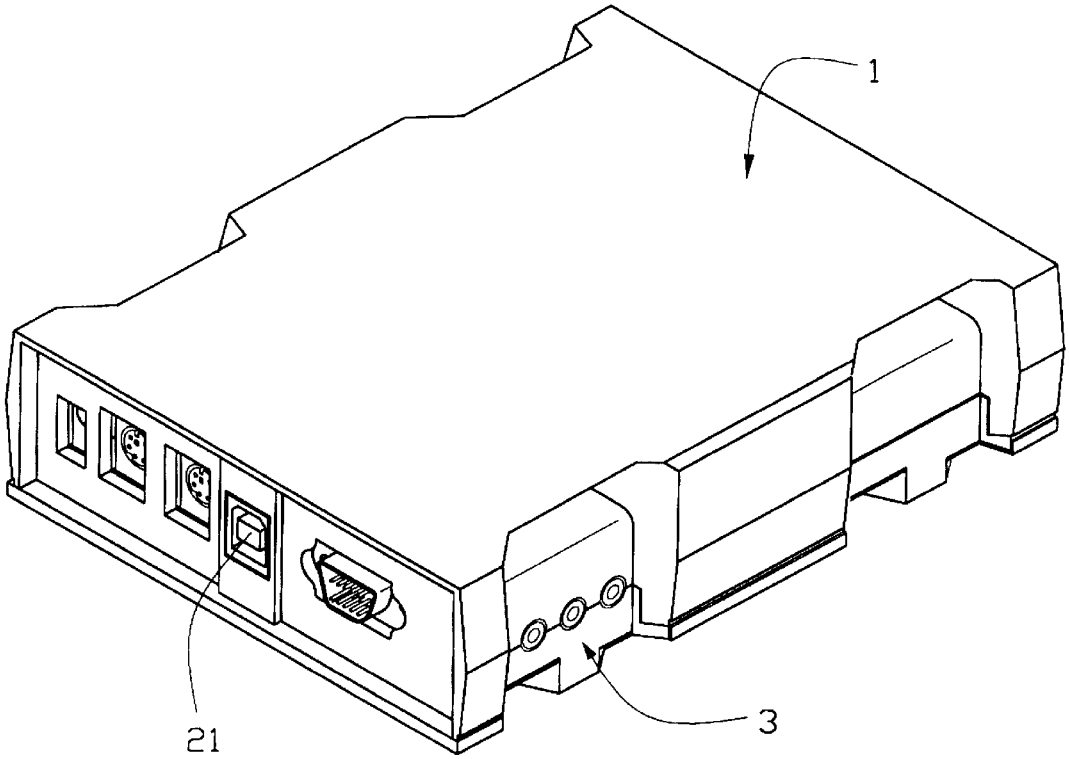
FIG. 2 is an assembled view of FIG. 1.

Referring to FIG. 1, a universal electrical connector station includes an upper shell 1, a circuit board 2, a lower shell 3. The circuit board 2 has a plurality of connectors 21 mounted on at least one side thereof. The upper shell 1 includes an upper body 11 and several upper ribs 17 extending from the upper body 11 adjacent to edges thereof. The lower shell 3 includes a lower body 31 and several lower ribs 39 extending from the lower body 31 adjacent to edges thereof. Upper side walls 12, 13 extend from the edges of the upper body 11, and joint to the upper ribs 17. First lower side walls 32, 34, and second lower side walls 34, 35, respectively extend from the edges of the lower body 31, and joint to the lower ribs 39. The first and second lower side walls 32, 33, 34, 35 are alternately arranged around the lower body 31. The circuit board 2 is assembled in the shells 1, 3 to be enclosed and protected thereby.

Figure 4:
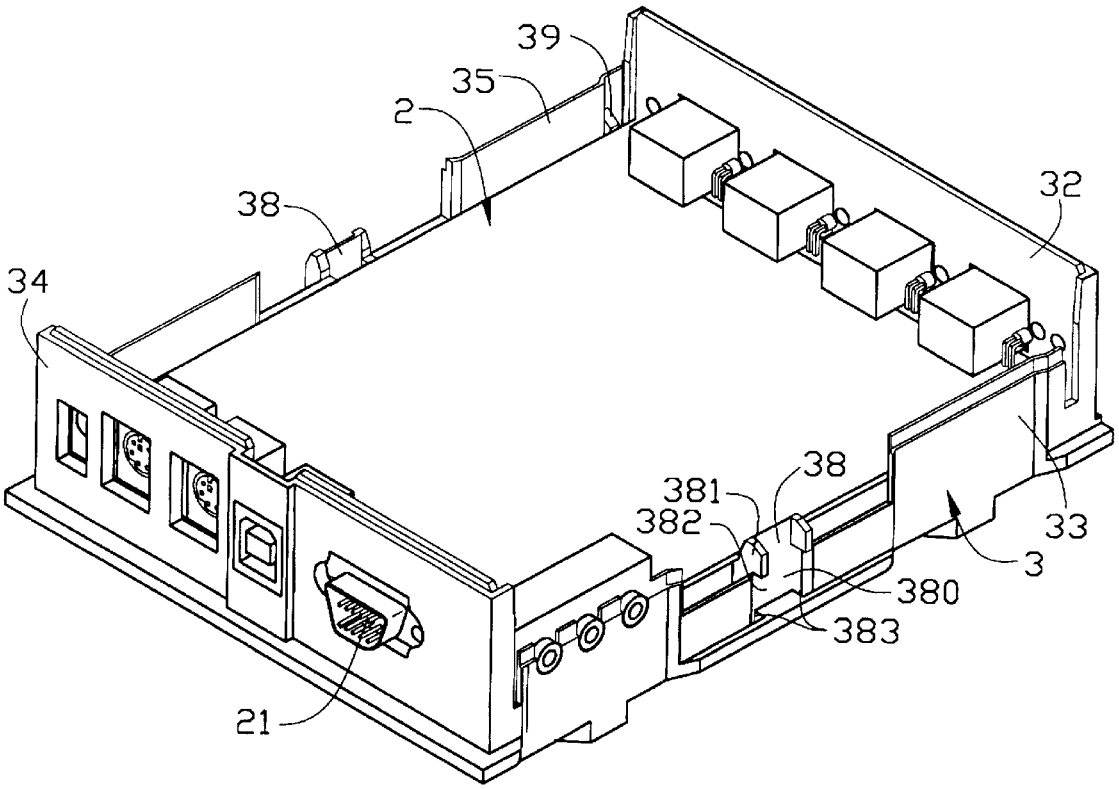
FIG. 4 is similar to FIG. 2 with the upper shell removed therefrom.

The first lower side walls 32, 34 extend from opposite edges of the lower shell 3, and a plurality of openings 36 are defined therein, such that the connectors 21 are engageable with external electronic devices (not shown). The second lower side walls 33, 35 extend from other opposite edges of the lower shell 3. A lower locking structure 38 is formed in a middle portion of each lower side wall 33, 35. The lower locking structure 38 comprises a lower extension portion 380 (see FIG. 4) upwardly extending from an edge of the lower body 31 and two blocks 381 formed on the lower extension portion 380. A space 382 is defined below the blocks 381. A through holes 383 is defined at a position below the blocks 381 of each lower locking structure 38 for extension of an external bar 4 (FIG. 5) therethrough to detach the upper shell from the lower shell. Two grooves 331, 351 are defined in opposite ends of each side wall 33, 35. The lower ribs 39 are formed on inner surfaces of the lower side walls 32, 33, 34, 35. Each rib 39 forms a shoulder 391, wherein the first and second shoulders 391 of all the ribs 39 are coplanar.

Figure 3:
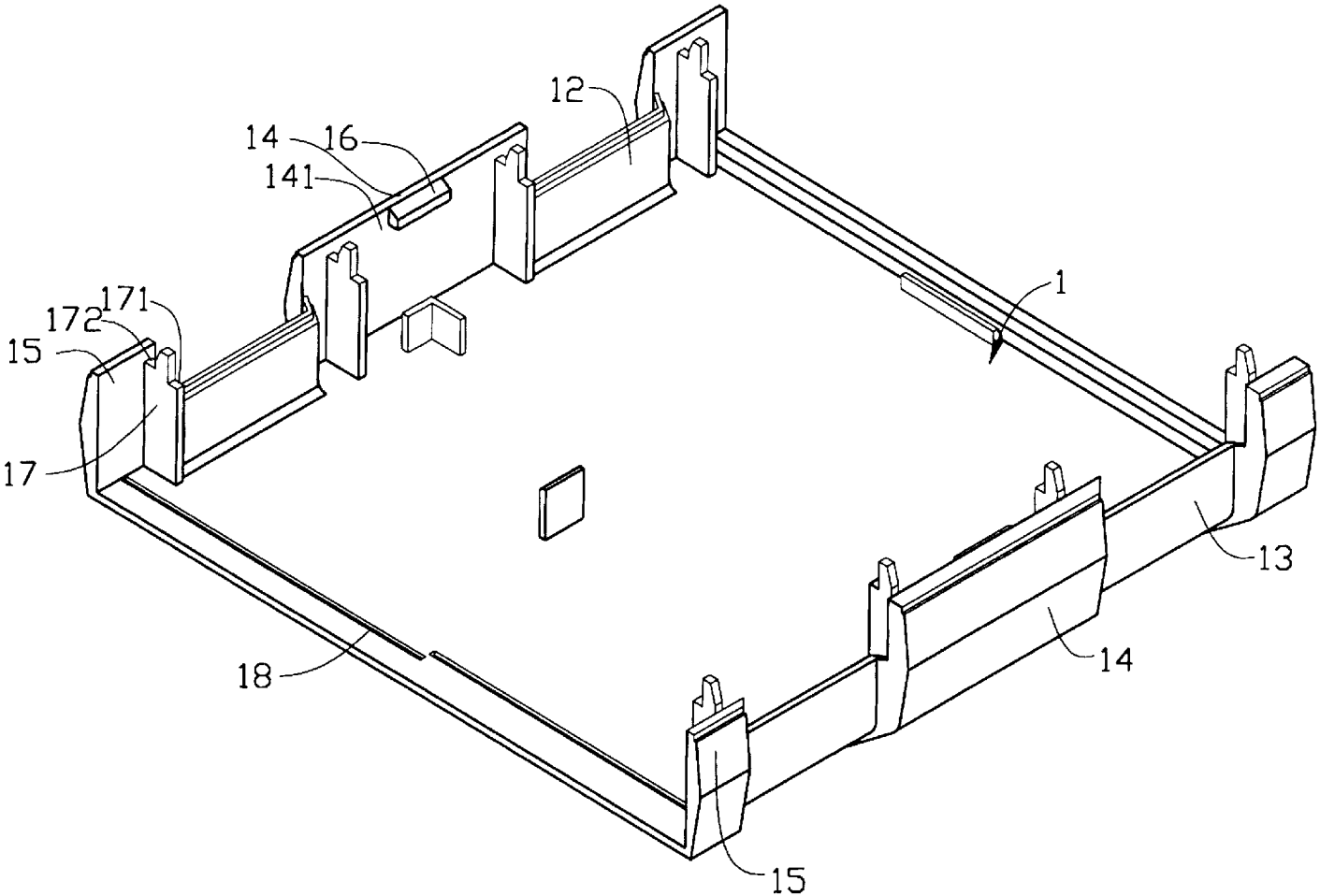
FIG. 3 is a perspective view of an upper shell of the present electrical connector station.

Referring to FIG. 3, the upper ribs 17 of the upper shell 1 extend from opposite edges of the upper body 11. An upper shoulder 171 is formed on each upper rib 17, and the upper side walls 12, 13 abut against the upper ribs 17 on sides opposite the upper shoulders 171. The upper shoulders 171 all lie in a same plane, and the distance between the upper shoulders 171 and the lower shoulders 391 is equal to the thickness of the circuit board 2 after the upper and lower shells 1, 3 are engaged together. A pair of upper locking structures 14 respectively further extend from edges of the upper side walls 12, 13. Each upper locking structure 14 includes an upper extension portion 141 and a protrusion 16 bulging from an inner surface of the upper extension portion 141. The protrusion 16 is generally parallel to the upper body 11. The upper extension portion 141 extends from a middle portion of each upper side wall 12, 13. A pair of second extension portions 15 extend from opposite ends of each upper side wall 12, 13. A recess 172 is defined between each upper rib 17 and the corresponding extension portion 141, 15. Particularly referring to FIG. 3, the upper body 11 defines a notch 18 in an inner face thereof adjacent to one of the edges of the upper body 11 between the upper side walls 12, 13 for engageably receiving a top portion of the first lower side wall 34.

Referring specifically to FIGS. 1 to 5, in assembly, the circuit board 2 is positioned in the lower shell 3 whereby edges of the circuit board 2 rest on the lower shoulders 391. The circuit board 2 is titled during placement so that the connectors 21 are properly received in the openings 36. The upper shell 1 is then attached to the lower shell 3 with the first and second lower side walls 32, 34 alternating with the upper side walls 12, 13, and the upper shoulders 171 further retaining the edges of the circuit board 2. The protrusions 16 of the upper shell 1 are received in the spaces 382 of the lower locking structures 38 whereby the protrusions 16 are engaged with the blocks 381. The upper side walls 12, 13 of the upper shell 1 abut against the second lower side walls 33, 35 of the lower shell 3 thus vertical movement of the upper shell 1 respect to the lower shell 3 is prevented. A portion of each upper rib 17 disposed at an outer end of the upper side walls 12, 13 is received in the corresponding groove 331 of the lower shell 3, and the recesses 172 of the upper ribs 17 receive corresponding portions of the lower side walls 33, 35 of the lower shell 3. The first lower side wall 34 extends a full height defined between the upper and lower bodies 11, 31 such that the top portion thereof is engageably received in the notch 18 of the upper body 11. Thus, horizontal movement of the upper shell 1 with respect to the lower shell 3 is prevented.

Figure 5:
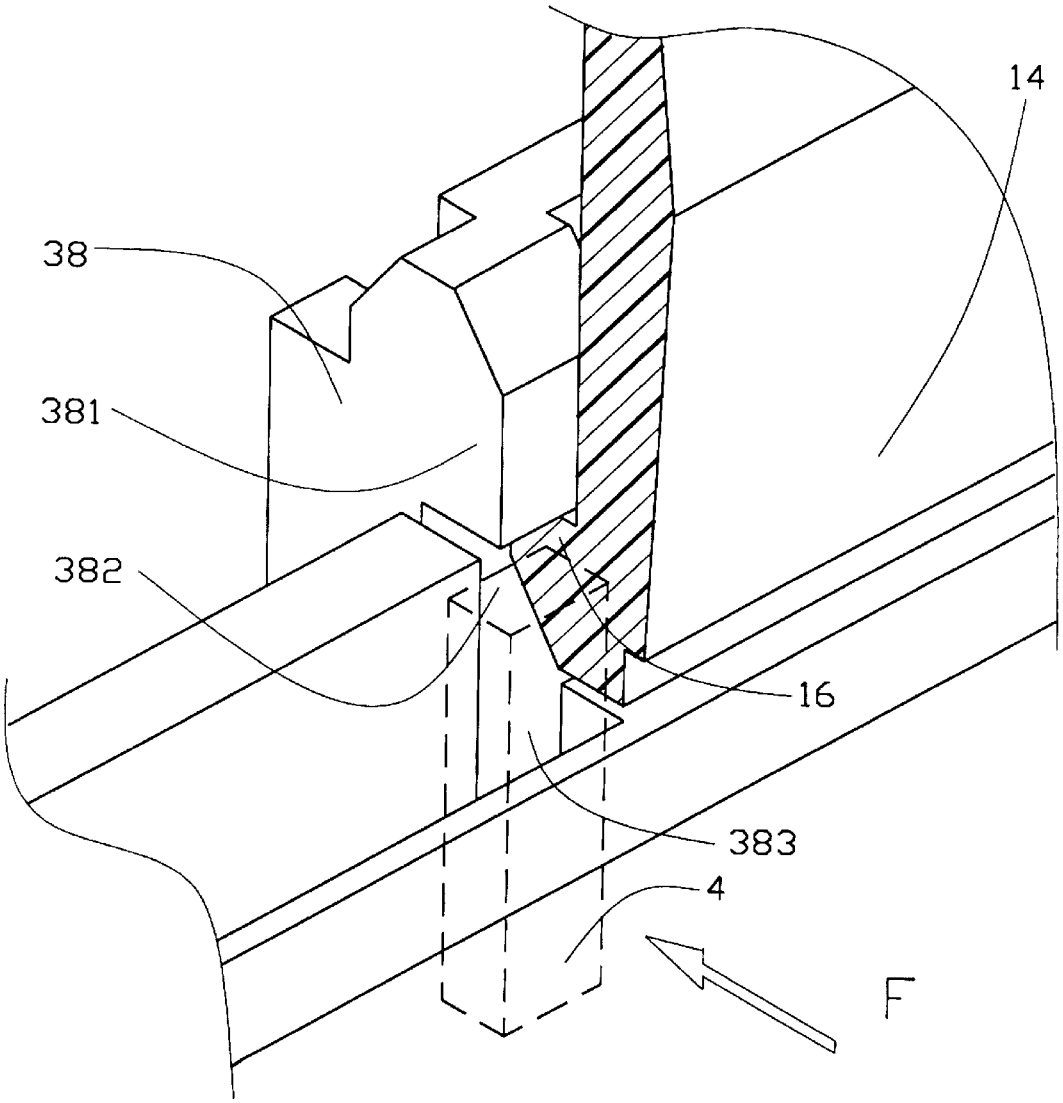
FIG. 5 is a partially, enlarged view of upper and lower locking structures of the present electrical connector station.

Referring to FIG. 5, to disengage the upper shell 1 from the lower shell 3, an external bar 4 is inserted into the through hole 383 until one end thereof contacts the upper extension portion 141. A force F exerted on the external bar 4 in the direction indicated by the arrow causes the upper extension portion 141 to be outwardly displaced whereby the protrusion 16 disengages from the block 381.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A universal electrical connector station comprising:

an upper shell comprising an upper body and two upper side walls extending from two opposite edges of the upper body, respectively;

a lower shell comprising a lower body and two first lower side walls extending from two opposite edges of the lower body, respectively, said two first lower side walls alternating with said two upper side walls;

a circuit board having a plurality of connectors mounted thereon, the circuit board being encapsulated in the upper and lower shells;

a plurality of openings defined in at least one of the two first lower side walls, said openings being adjacent to corresponding connectors of the circuit board such that these connectors are engageable with an external electronic device; and a pair of upper locking structures and a pair of lower locking structures respectively provided on the two upper side walls and other two opposite edges of the lower body, said pair of lower locking structures alternating with said two first lower side walls, the upper and lower locking structures engaging with each other thereby locking the upper and lower shells together; wherein the lower shell further comprises two second lower side walls respectively extending from said other two opposite edges of the lower body and having said pair of lower locking structures thereon, and said second lower side walls is shorter in height than the first lower side walls.

2. The universal electrical connector station as claimed in claim 1, wherein:

each upper locking structure comprises an upper extension portion and a protrusion bulging inward from the upper extension portion, said protrusion being generally parallel to the upper body; and each lower locking structure comprises a lower extension portion and one or more blocks formed on the lower extension portion, the protrusion engaging with the one or more blocks thereby joining the upper and lower shells together.

3. The universal electrical connector station as claimed in claim 1, wherein the lower locking structures are provided at a middle of the second lower side walls, and the upper locking structures are provided at positions corresponding to the lower locking structures.

4. The universal electrical connector station as claimed in claim 2, wherein at least one through hole is defined through the lower body below the one or more blocks of at least one lower locking structure for extension of an external bar therethrough to disengage the protrusion of the upper shell from the one or more blocks of the lower shell.

5. The universal electrical connector station as claimed in claim 1, wherein a plurality of ribs are formed on inner portions of the first lower side walls and the upper side walls, a shoulder being formed on each rib and supporting the circuit board at a predetermined position.

6. The universal electrical connector station as claimed in claim 1, wherein two grooves are defined in opposite ends of each second lower side wall engageably receiving parts of the two upper side walls.

7. A station housing comprising:

an upper shell having an upper body and several upper side walls extending from edges of the upper body;

a lower shell having a lower body with four edges thereof and two first lower side walls extending from two opposite edges of the lower body and two second lower side walls extending from the other two opposite edges of the lower body, each of said two first lower side walls defining therein openings adjacent to corresponding connectors on a printed circuit board which is embedded within the housing; and a pair of upper locking structures and a pair of lower locking structures respectively provided on opposing upper side walls and said two second lower side walls for engaging the upper shell with the lower shell; wherein each upper locking structure comprises an upper extension portion and a protrusion bulging inward from the upper extension portion, said protrusion being generally parallel to the upper body; and each lower locking structure comprises a lower extension portion and one or more blocks formed on the lower extension portion, the protrusion being engageable with and disengageable from the one or more blocks.

* * * * *